United States Patent [19]

Bischofberger et al.

[11] Patent Number: 4,680,925

[45] Date of Patent: Jul. 21, 1987

[54] OPEN-END YARN PIECER

[75] Inventors: Jürg Bischofberger, Elsau; André Lattion, Seuzach, both of Switzerland

[73] Assignee: Rieter Machine Works, Ltd., Winterthur, Switzerland

[21] Appl. No.: 611,709

[22] Filed: May 18, 1984

[30] Foreign Application Priority Data

May 20, 1983 [GB] United Kingdom ..... 8313993

[51] Int. Cl.[4] ..... D01H 15/02

[52] U.S. Cl. ..... 57/263; 57/261; 57/405

[58] Field of Search ..... 57/261, 262, 263, 22, 57/405

[56] References Cited

U.S. PATENT DOCUMENTS

| | | | |
|---|---|---|---|
| 3,640,059 | 2/1972 | Lutovsky et al. | 57/263 |
| 3,695,017 | 10/1972 | Hori et al. | 57/263 |
| 3,810,352 | 5/1974 | Miyazaki et al. | 57/263 |
| 3,858,385 | 1/1975 | Shinkai et al. | 57/263 |
| 4,041,684 | 8/1977 | Kamp | 57/263 |
| 4,120,140 | 10/1978 | Raasch | 57/263 |
| 4,125,990 | 11/1978 | Stahlecker et al. | 57/263 |

FOREIGN PATENT DOCUMENTS

| | | |
|---|---|---|
| 2610575 | 9/1977 | Fed. Rep. of Germany . |
| 2717314 | 11/1978 | Fed. Rep. of Germany . |
| 2728003 | 1/1979 | Fed. Rep. of Germany . |
| 606533 | 11/1978 | Switzerland . |
| 1357422 | 6/1974 | United Kingdom . |
| 2035395 | 6/1980 | United Kingdom . |

*Primary Examiner*—John Petrakes

*Attorney, Agent, or Firm*—Kenyon & Kenyon

[57] ABSTRACT

The travelling piecer carries a lever to separate the nip rollers, a yarn reserve forming device to receive the yarn and a threading device for threading a broken yarn from a package between the nip rolls and through the yarn reserve forming device. The piecer also has a control which effects a piecing operation in which a clutch is actuated to feed fiber into the spinning unit while yarn is back-fed into the unit from the yarn reserve. At the completion of a predetermined time period (T) the nip rolls are re-engaged to withdraw the re-pieced yarn.

18 Claims, 20 Drawing Figures

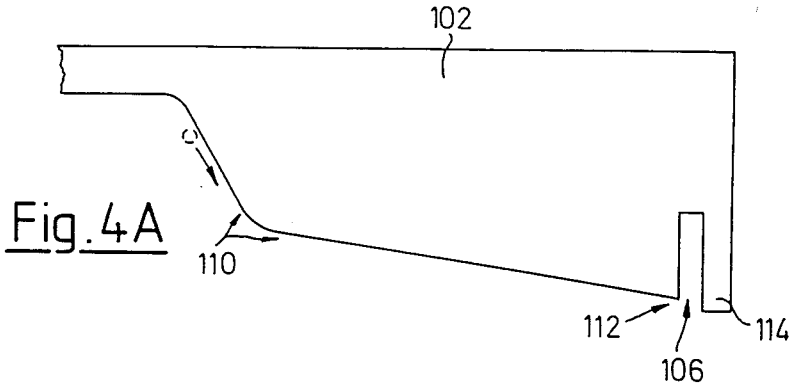
Fig. 4A
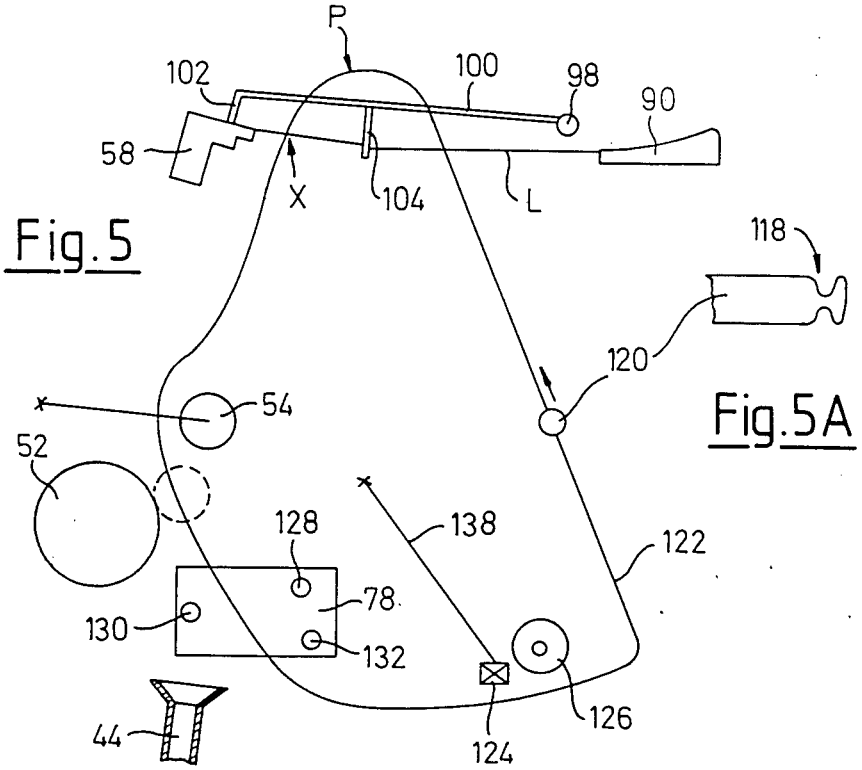
Fig. 5
Fig. 5A

Fig. 10
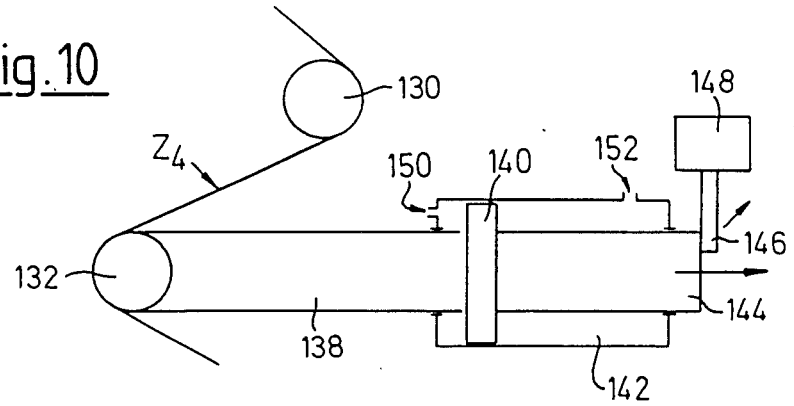
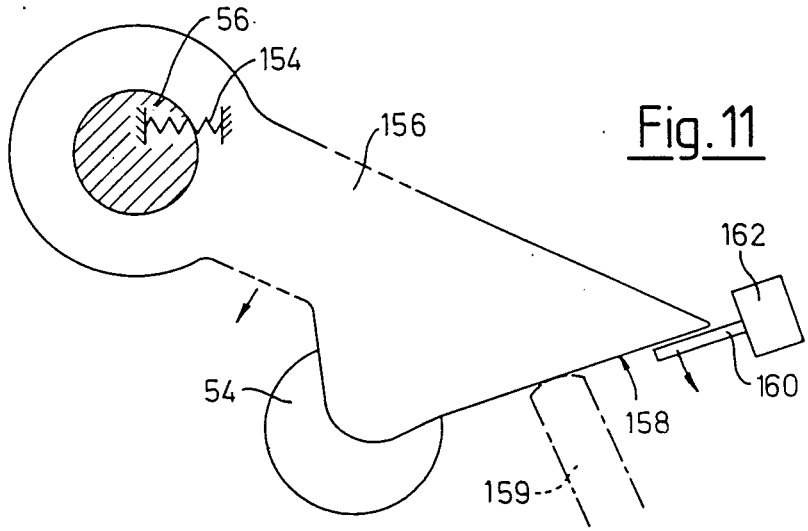
Fig. 11
Fig. 12
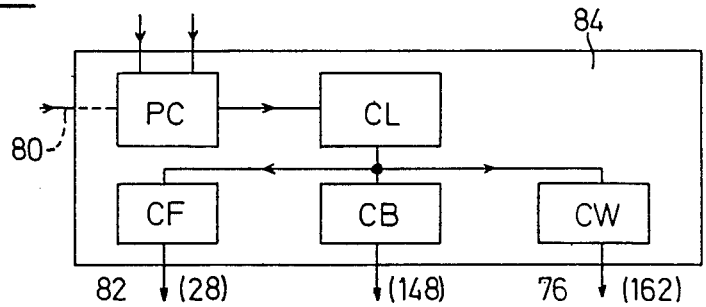

OPEN-END YARN PIECER

The present invention relates to methods and apparatus for piecing a rotor spinning machine of the type (hereinafter referred to as "type described") comprising a plurality of spinning stations, each including a rotor unit, package forming means to form a package of yarn produced at the unit, a nip roll pair for withdrawing yarn from the unit and feeding it to said package forming means, feed means selectively operable to feed fibers to said unit for spinning into yarn and drive means operable to drive the rotor unit at a selected operating speed and to drive the package forming means, nip roll pair and feed means at respective speeds each in a selected relationship to said operating speed.

Rotor spinning machines of the type described are now extremely well-known in the rotor spinning art. By way of example only, details of such machines can be obtained from U.S. Pat. No. 3,375,649.

At present, the majority of the rotor spinning machines in commercial use are operated by manual attendance. In particular, start-up of the machine, doffing of packages and repair of thread breaks are dealt with by hand. In each of these operations, a so called "piecing" operation is required; that is, a previously spun "seed" yarn must be backfed into the rotor spinning unit to join or "piece" with a ring of fibers formed in the rotor, the seed yarn then being withdrawn from the spinning unit and bringing with it newly spun yarn formed in the rotor.

With increasing rotor speeds, particularly speeds substantially in excess of 50,000 RPM, manual piecing becomes increasingly difficult. Since commercial rotor speeds are now approaching the 80 to 90,000 RPM region, it is becoming imperative to provide at least mechanised piecing assistance and preferably fully mechanised, or automated, machine attendance.

A commercial rotor spinning machine comprises a large number (usually approx. 200) spinning stations. For economic reasons, it is preferred not to provide individual piecing means at each of these stations, but instead to provide a travelling piecing apparatus movable from station to station and capable of performing a piecing operation at any selected station.

One example of a travelling piecing apparatus of a kind referred to above is shown in U.S. Pat. No. 4,041,684. This specification shows a piecing apparatus with a means for separating the nip roll pair on a station to be serviced and for threading a seed yarn (a broken yarn end on the yarn package at the station) with the separated nip rolls before backfeeding the seed yarn into the spinning unit. Subsequent withdrawal of the seed yarn and newly formed yarn pieced thereto is effected by re-engaging the nip roll pair. However, so far as present applicants are aware, the company owning U.S. Pat. No. 4,041,684 has not produced a commercial apparatus in accordance with the patent. Instead, the system offered by that company on the market involves withdrawal of seed yarn and newly spun yarn from the rotor spinning unit via a withdrawal path passing through the piecing apparatus and by means of a withdrawal unit specifically provided for this purpose in the travelling piecing apparatus. After completion of the yarn piecing operation, therefore, control of the withdrawal operation has to be passed back from the piecing apparatus to the machine—this substantially complicates operation of both the travelling piecing apparatus and the machine.

Furthermore, several commercial piecing systems presently available depend upon piecing at a rotor speed which is substantially lower than the normal operating speed of the rotor, e.g. a piecing speed of approx. 40,000 RPM in comparison with a normal operating speed in the region 70 to 80,000 RPM. By way of example only, details of a "low speed piecing" technique can be seen from U.S. Pat. No. 4,012,116. The low speed piecing technique renders certain factors less critical to the success of the piecing operation. However, it also brings certain complications which will be explained in detail below in the course of explanation of the illustrated embodiments of the present invention and by way of contrast with the relatively straightforward technique enabled by this invention.

PRESENT INVENTION

In the present invention, withdrawal of yarn after piecing with a fiber ring in the rotor is effected by re-engaging previously separated withdrawal rolls on the rotor spinning machine, as is known from the U.S. Patent referred to above. Feeding of the seed yarn back to the rotor and initiation of withdrawal of the seed yarn and newly spun yarn pieced thereto can be effected while the spinning unit is operating at a predetermined constant speed, preferably at or near the selected normal operating speed for the spinning unit. Thus, if the machine is set to drive its spinning units at, say, 80,000 RPM, the piecing operation is preferably carried out while the spinning unit is operating at or near to 80,000 RPM.

A predetermined time period is defined at the expiry of which withdrawal of seed yarn is commenced. By adjusting the backfeed of seed yarn relative to this predetermined time period, the duration of a "rest period" is determined. During this rest period, the end of the seed yarn is in the rotor groove and twist is transferred from the seed yarn to fibers in the groove. By control of the rest period, twist transference to the fibers is controlled.

Further features of the invention will be apparent from the description of the drawings, in which—

FIG. 1 is a diagrammatic side elevation of one spinning station of a rotor spinning machine of the type described, the diagram showing the relations of the parts of the station and co-operation thereof with a travelling yarn piecer, FIG. 2 is a speed vs time diagram for use in explanation of the piecing technique of the invention, the speed scale (vertical axis) being different for the rotor speed and yarn speed diagrams, FIG. 3 is a more detailed side elevation, also diagrammatic, of the package forming means of a spinning station and co-operation thereof with the piecer, the spinning station being on the opposite machine side relative to that shown in FIG. 1, FIG. 4 is a view in the direction of arrow A in FIG. 3, FIG. 4A illustrates a detail part of FIG. 4, FIG. 5 is a diagrammatic side elevation of the path of movement of a yarn threading element of a piecer according to the invention, FIG. 5A illustrates a detail of a pin used in the threading element of FIG. 5, FIGS. 6–9 inclusive are diagrammatic side elevations of successive yarn paths adopted by a seed yarn during preliminary stages of a piecing operation according to the invention, FIG. 10 is a diagrammatic representation of a yarn reserve release device for a piecer according to the invention, FIG. 11 is a diagrammatic representation of a nip roll pair of a machine of the type described in cooperation with a roll separating means for a piecer according to the invention, FIG. 12 is a block diagram of a timing means for a piecer according to the invention, FIG. 13 is a plan view of the floor portion of a rotor showing an arrangement of markings adapting the rotor for use with the piecer of FIG. 1, FIG. 14 is a diagrammatic representation of a yarn clamping device suitable for use in a piecer according to the invention.

FIGS. 15 and 16 are diagrams similar to FIGS. 4 and 5 but showing a modification, and FIGS. 17 and 18 illustrate details of embodiments of the modification shown in FIGS. 15 and 16.

In the description of the drawings and in the claims the terms "upstream" and "downstream" are used. These terms relate directions and positions to the direction of travel of the yarn out of the spinning unit to the package forming means during normal spinning operation, that is, in FIG. 1 "downstream" is upwards relative to the Figure since the package forming means is located above the spinning unit.

DESCRIPTION OF THE DRAWINGS

The principles involved in the present invention will first be described with reference to FIGS. 1 and 2. Mechanisms for putting those principles into effect will then be described with reference to the other Figs.

Spinning Station Construction

Figure 1:
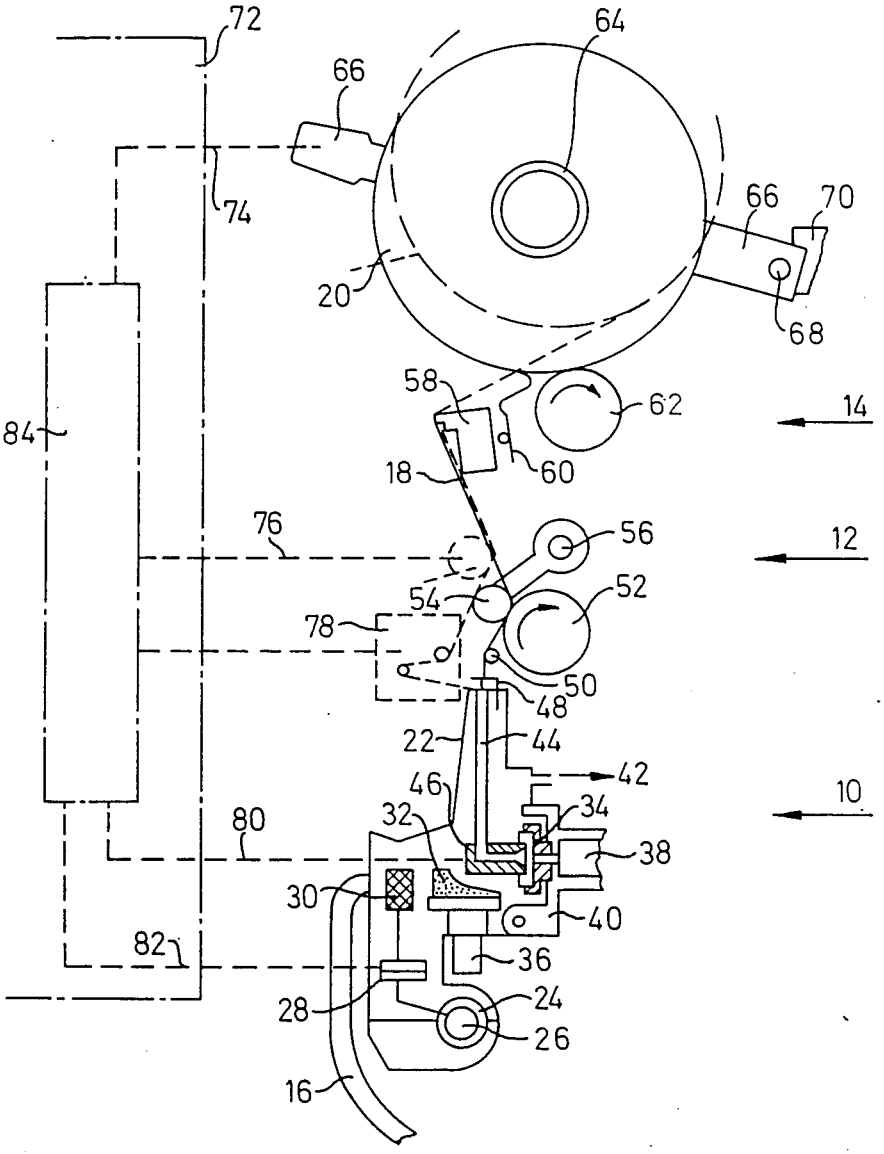
FIGS. 1 and 2 are diagrammatic only and are in no way intended to represent exactly either a practical machine design or an exact piecing sequence.

The full line diagram in FIG. 1 illustrates in side elevation one spinning station of an open-end spinning machine. There would be many such stations arranged side by side in a practical machine, nowadays commonly up to 100 stations per machine side.

The dotted line illustration in FIG. 1 represents a piecing apparatus which normally travels to and fro past the spinning stations but which can be stopped in alignment with a selected station in order to perform a piecing operation as will be outlined. The dotted line illustrations in FIG. 1 also show certain modified positions of the elements of the spinning station and of the thread path during a piecing operation.

The illustrated spinning station comprises a spinning unit indicated generally by the numeral 10, a yarn withdrawing means indicated generally by the numeral 12 and a package forming means indicated generally by the numeral 14. In normal operation of the spinning station, a sliver 16 of staple fiber is drawn into the unit and is converted therein to a yarn 18. The yarn is withdrawn from unit 10 by means of the withdrawal means 12 and is forwarded to the package forming means 14 at which it is wound into a package 20.

The spinning unit 10 is of a type very well known in the rotor spinning art. Details can be omitted. The general type of spinning unit involved can be seen from U.S. Pat. Nos. 3,511,045 and 4,009,562. FIG. 1 shows the outline of a unit housing 22 which is pivotally mounted on a tube 24 which extends over the full length of one machine side being fixed in the machine frame and common to all spinning stations on the one machine side. Extending through the bore of tube 24 is a worm gear 26 also extending along a complete machine side.

At each spinning station there is a drive shaft coupling (not shown) to the worm gear 26 which therefore drives the input side of a clutch 28. The output side of clutch 28 is coupled to a knurled feed roller 30.

Feed roller 30 draws the sliver 16 into the spinning unit and presents the sliver to an opening roller 32 having pins or teeth to comb individual fibers out of the presented sliver end. The fibers extracted from the sliver are forwarded by an airstream to a rotor 34. Opening roller 32 is driven by a whorl 36 projecting from the underside of the housing 22 so as to be engageable with a drive belt (not shown) common to all of the spinning stations.

Rotor 34 is carried by way of a bearing unit 38 on a carrier 40 which is pivotally connected to the housing 22. FIG. 1 shows the parts in their normal operating disposition in which housing 22 is latched in an "upright" disposition and carrier 40 holds the axis of rotor 34 substantially horizontal. Housing 22 can be unlatched and tilted forwardly (that is, in an anticlockwise direction) on its pivot mounting on tube 24 and carrier 40 can simultaneously pivot rearwardly (in a clockwise direction) on its pivotal connection with housing 22. In this manner, the rotor unit (34, 38, 40) can be separated from the fibre feed system (30, 32) for ready access to the interior of the rotor.

The air stream which draws fibers from the opening roller 32 to the rotor 34 is created by a vacuum applied to the housing 22 for example as indicated at 42. A feed and guide tube (not shown) leads the fiber—carrying air stream from the opening roll through a rotor cover (not shown) into the rotor interior where the fibers are separated from the carrying air by centrifugal force and are laid as a fiber ring in the so called "rotor groove" at the maximum interior diameter of the rotor. The air escapes over the rotor rim and is removed by the suction system (not shown). For further detail of these arrangements see U.S. Pat. No. 3,481,129.

The formed yarn is withdrawn from the rotor via a withdrawal tube 44 which extends at its upstream end through a withdrawal nozzle 46 mounted in the rotor cover. After leaving the withdrawal tube 44, the yarn passes a pivotable monitor 48. This monitor is also of a well known type comprising a lever pivoted to swing on an arc which intersects the normal yarn path. The lever is biased towards one position on its arc and is maintained spaced from that position by the normally running yarn. If the yarn breaks, or the yarn tension drops severely, the lever is pivoted under its bias to close a switch indicating a fault condition. Such a monitor is shown, for example, in U.S. Pat. No. 3,404,524.

From monitor 48, the yarn passes to the withdrawal means 12 which comprises a guide 50, a drive roller 52 and a pressure roll 54. Guide 50 reciprocates the yarn over a slight traverse axially of the withdrawal rollers 52, 54 to avoid persistent wear at one location of those rollers. The primary withdrawal function is performed at the nip normally formed between the rollers 52 and 54. Roller 52 extends along the complete side of the machine, being common to all stations. It is driven in a clockwise direction about its own axis, as indicated by the arrow in FIG. 1. At each spinning station there is a respective pressure roller 54 mounted by a carrier arm on a rod 56 extending the full length of the machine side. The carrier arm is pivotable on the rod 56 to move the roller 54 from the full line position to the dotted line position. During normal operation, the roller 54 is in its full line position in which it engages roller 52 to form a nip therebetween. The yarn 18 is withdrawn from the spinning unit by means of this nip and the drive on the roller 52. The withdrawal speed is determined by the speed of rotation of the roller 52.

The package forming means 14 comprises a fixed guide 58, a traversable guide 60 and a drive roller 62. Guide 60 is traversed (by means not shown) axially of the package 20. The latter normally rests in frictional engagement with the roller 62 which extends along a full machine side and is common to all spinning stations. Roller 62 is driven to rotate clockwise as viewed in FIG. 1 about its own longitudinal axis, thereby rotating the package in a anti-clockwise direction. The traverse motion of the guide 60 enables formation of a cross-wound package. The portion of guide 58 which contacts the yarn is formed to even out yarn length variation which would otherwise occur during the traverse motion. This general arrangement is also very well known in the art.

Package 20 is formed on a bobbin tube 64 carried between a pair of arms of a package cradle. Only one arm 66 can be seen in FIG. 1. The arms are pivotable together about a pivot mounting 68 on the machine frame, part of which is shown at 70.

In the event of a thread-break which may be due to a fault or may be deliberately induced (for example at completion of winding of a package of a predetermined size or when cleaning of the spinning unit 10 is due), the thread break signal issued by the monitor 48 causes operation of a mechanism (not shown) to lift the package 20 to the position illustrated in dotted lines in which it is clear of roller 62. The latter continues in rotation to drive the packages at the other spinning stations, but rotation of the package ceases at the station with the broken thread. The thread break signal also opens the clutch 28, so that feed of sliver 16 also ceases. The drive to the gear 26, whorl 36, rotor 34, withdrawal roll 52, and traverse guide 60 continues.

Piecing—General

A call signal is also issued to cause the automatic piecer 72 to stop in alignment with the illustrated station. When it is correctly registered with the station, piecer 72 carries out a piecing operation which basically involves finding the broken thread end on the package 20 and feeding it back down the withdrawal tube 44 to rejoin that end with a newly formed ring of fibers in the rotor groove. As soon as the backfed yarn has formed an effective join with the fiber ring in a rotor, withdrawal of the newly formed yarn must be restarted. As is well known in the art, and widely documented in the relevant literature over the last ten years, control of the three operations (yarn backfeed, fiber feed and yarn withdrawal) is critical and extremely difficult to achieve at least with rotor speeds substantially higher than 50,000 RPM.

Accordingly, in all currently available automatic piecing devices, steps have been taken to modify the normal spinning conditions for the purposes of the piecing operation. For example, in all commercially available piecing devices, the yarn path between the spinning unit and the package is diverted to pass through the piecing device, and the yarn must be passed back to the machine at the completion of a successful piecing operation. In certain systems, piecing is effected at a rotor speed which is lower than the normal operating speed, usually during acceleration of the rotor towards its normal operating speed. Despite these measures, the piecings, or joins, obtained from the currently available devices do not always meet the requirements of the further processing industries, and the piecing is frequently cut out and replaced by a knot or a splice after spinning at the spinning unit has been successfully restarted.

All of the above steps complicate the system and make it more expensive. In the system now to be described, piecing is effected under conditions approaching as closely as possible to those which occur during the normal spinning operation.

The dotted lines extending between the piecing device 72 in FIG. 1 and the spinning station in that Figure indicate the main points at which the piecing device intervenes in the spinning station to effect piecing. Thus, the piecer takes over control of the position of the package 20 relative to the friction roller 62 as indicated by line 74 joining the piecer to package holder arm 66. The piecer can be provided with a suitable lever for this purpose. The piecer also lifts pressure roller 54 away from drive roller 52 and moves it to the dotted line position as indicated by the line 76 joining the piecer to that position. Again, the piecer can be provided with a suitable lever for this purpose.

The piecer further forms a yarn reserve which is a defined length of yarn, the length of the reserve being equal to the distance through which the yarn end will move in the last stage of the piecing operation in order to bring it into contact with the fiber ring in the rotor groove. For this purpose, the piecer locates a reserve forming device 78 adjacent the exit end of the withdrawal tube 44.

The piecer may have a device for sensing the speed of rotation of the rotor. The device is indicated by the dotted line 80 in FIG. 1 and a suitable arrangement will be described below. The piecer also has a means (indicated by the dotted line 82) for controlling operation of the clutch 28.

The piecer 72 is also provided with certain elements which have not been shown in FIG. 1. In particular, there is a means for finding the broken thread end on the package 20 and a device for threading the found yarn along the thread path indicated by dotted line between package 20 and the exit end of the withdrawal tube 44. It will be noted, in particular, that the yarn is threaded between the separated nip rollers 52, 54 and into the reserve forming device 78. There is also a device which forms a prepared end on the yarn and a device for performing a preliminary backfeed operation in which this prepared yarn end is inserted into the downstream end of the withdrawal tube 44 and is drawn by the suction on that tube to a position at or near the upstream end of the nozzle 46. Thus, the final backfeed phase which is performed under the control of the reserve device 78, carries this yarn end from the nozzle 46 into the rotor groove.

The piecer further includes a rotor cleaning device. The device will not be described in the present application but can be formed, for example, in accordance with U.S. Pat. No. 4,403,472. Cleaning of the rotor is performed simultaneously with the end seeking operation. In order to perform the cleaning operation, the spinning unit must be opened in order to provide access to the rotor interior, and the rotor must be braked to a standstill. The dotted line yarn path shown in FIG. 1 and the location of the yarn end within the nozzle 46 are established after reclosing of the spinning unit following completion of the cleaning operation. At that time, also, drive will be reestablished with the rotor, which will begin to accelerate towards its normal operating speed.

Piecer 72 also includes a control means 84 which controls all functions of the piecer according to a predetermined sequencing program. Certain aspects of the program will be described in further detail with reference to the more detailed mechanisms. However, particular attention will first be paid to the final stage of the piecing operation, in which—

(a) a ring of fibers of controlled dimensions is formed in the rotor groove by operation of clutch 28, (b) the prepared yarn end is fed back from the nozzle 46 to join with this fiber ring by operation of the reserve device 78, and (c) withdrawal of newly formed yarn is restarted by return of roller 54 into re-engagement with roller 52 to form the withdrawal nip.

The timing of the commencement of fiber feed in relation to the other operations has been extensively dealt with in the literature and will not be covered again here. Reference can be made for example to U.S. Pat. No. 4,102,116. Briefly, the aim of fiber feed control is to achieve a fiber ring of appropriate dimensions so that the piecing is neither too thick nor too thin in relation to the normal yarn count. In general, this is a matter of timing of the operation of clutch 28 in relation to the other two operations which will be discussed in additional detail with reference to FIG. 2.

Piecing—Timing

Figure 2:
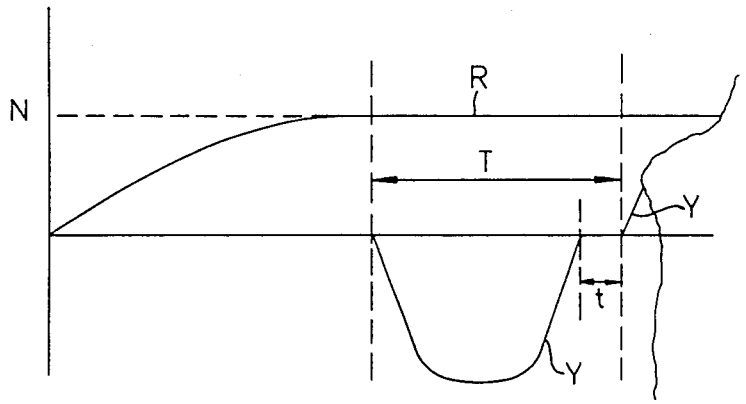

In the graph of FIG. 2 the vertical axis represents speed and the horizontal axis represents time. The line R represents the speed of the rotor, and the line Y represents the speed of the yarn end/piecing. The scale of the diagram is different for the rotor speed and the yarn speed, since only the principle is of importance.

At the left hand side of the diagram of FIG. 2 the rotor is assumed to be reconnected with its drive after the cleaning operation. The rotor speed then follows an acceleration curve which will be dependent upon the overall design of this system and which will be inevitably subject to minor variations from one station to another because of manufacturing and assembly tolerances. After the rotor has reached its normal operating speed N, the control 84 provides a start signal to start the final piecing stage. The issuance of the start signal is dependent upon the completion of the preliminary piecing operations referred to above which will normally last longer than the acceleration time of the rotor R.

The control 84 now defines a predetermined time T during which the formation of the fiber ring, the backfeed of the yarn end and joining of the yarn to the fiber ring can occur. At the expiry of this time T, the roller 54 has again engaged the roller 52 so that withdrawal of yarn from the spinning unit is commenced.

In accordance with the backfeed operation indicated by the full line Y shown in FIG. 2, backfeed is assumed to be initiated as soon as the start signal is issued. There can be a delay between the start signal and initiation of backfeed. Device 78 is operated to provide a controlled backfeed such that the yarn is continually tensioned along its length during the backfeed operation and so that the yarn end arrives in the groove with a slight time advance relative to the start of yarn withdrawal. For the backfeed operation indicated by full line in FIG. 2, the corresponding time advance is indicated at t. The time advance may be greater or less depending upon delay in initiation of the backfeed.

Consider now the motion of the yarn end between the upstream end of nozzle 46 and the rotor groove. As the yarn end enters the rotor system, the yarn begins to rotate about the nozzle axis with the rotor and the yarn end is drawn out by centrifugal force towards the rotor groove. Rolling of the yarn around the internal surface of the nozzle 46 increases the already available twist in the yarn. When the yarn end reaches the groove and begins to mix with the fibers therein, the yarn twist begins to collect the fibers from the groove and joins them into the yarn.

In order to form a good join between the backfed yarn end and the fibers, a predetermined quantity of twist must be transferred from the backfed yarn to the newly forming yarn in the rotor groove. If the degree of twist transference is too low, the strength of the join will be inadequate and the yarn will break when withdrawal is attempted. If an attempt is made to transfer too much twist to the piecing, then a yarn break will occur due to "overtwist" either of the backfed yarn or of the piecing. The degree of twist transference to the piecing is dependent upon two factors, namely—

(a) the amount of twist present in the backfed yarn when it arrives in the rotor groove, and (b) further twist imparted to the backfed yarn while the yarn end is present in the rotor groove and forming the join.

Factor (a) is dependent upon the backfeed speed in relation to the rotor speed and factor (b) is dependent upon the length of the advance referred to above, that is the duration of the "rest" period during which the yarn end remains in the groove waiting for yarn withdrawal to begin. In principle, the degree of twist transference can be controlled by controlling both factors (a) and (b) above, but we prefer to apply the main control via factor (b) (that is by adjustment of the rest period) and to hold factor (a) constant (that is to maintain constant backfeed speed for all piecing operations). Also, in principle, it would be possible to detect the completion of the backfeed movement and then to measure out a defined rest period. However, the rest period required in practice is of extremely small duration (up to 10 millisecs.) and it is impractical to initiate the mechanical operations involved in yarn withdrawal within the very short time available after sensing of completion of the backfeed movement.

For the above reasons, it is preferred to define the initiation of withdrawal by reference to the start signal and to define the duration of the rest period by reference to the delay (or lack of it) between the start signal and the initiation of the backfeed movement.

The required duration of the rest period will depend upon the operating circumstances, and in particular upon the rotor speed and yarn count. A heavier yarn count will require greater twist transference and thus a longer rest period.

Closing of the clutch 28 is also preferably effected by reference to the same start signal. Closing of the clutch must be effected at a stage of the piecing sequence such that a fiber ring of the required dimensions is available in the groove during the rest period to join with the yarn end. The actual stage of the sequence at which initiation of fiber feed must be effected will depend upon many factors including the mechanical design of the system and the yarn count. Frequently, fiber feed must be commenced before start of the backfeed movement and the total time T must then be settable to allow for an initial "feed delay" following the start signal, plus the time required for the backfeed movement plus the required rest period.

Approximately simultaneously with restart of yarn withdrawal, package 20 is returned to contact with the drive roll 62 so that packaging of yarn can be re-commenced. There will be substantial differences in the rate at which yarn is taken up by the package immediately after the latter contacts the drive roller 62 depending upon the surface conditions of the package, and its size (weight). Accordingly, in order to take up temporary excess yarn length between the nip rolls 52, 54 and the package 20, a suction storage device of a known type may be brought into association with the yarn path between the nip rollers and the package. There will thus be substantial yarn tension variations between the nip rolls and the package, but these have no undesirable influences on the spinning operation because the nip rolls isolate these tension variations from the spinning unit 10.

More detailed examples of mechanisms enabling the piecing operation outlined above will now be described with reference to the remaining figures. In those figures, parts identical with parts shown in FIG. 1 are indicated by same reference numerals. All figures are still diagrammatic, however.

Yarn End Finding

Figure 3:
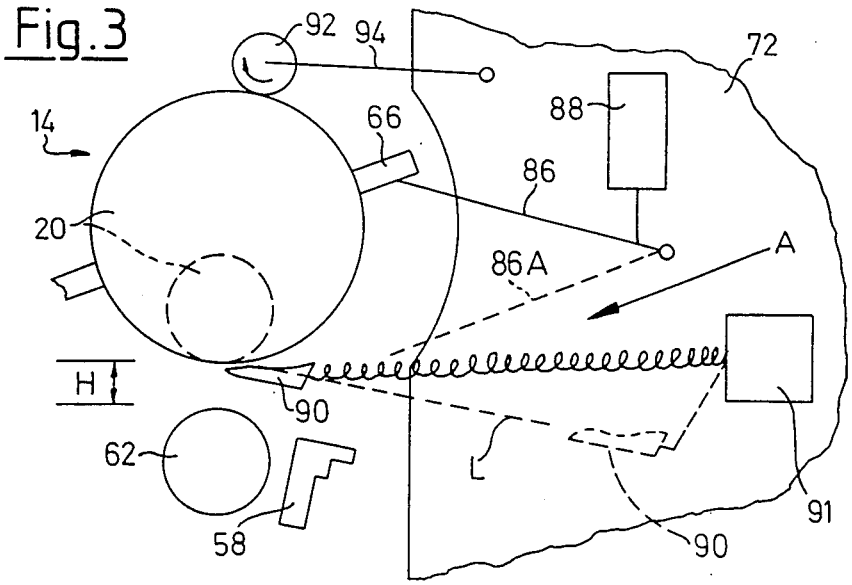
Figure 4:
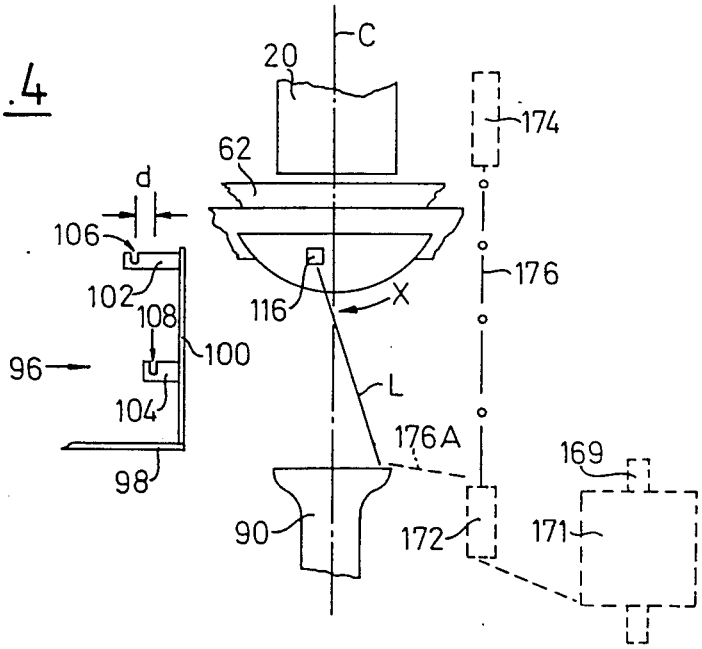

FIGS. 3 and 4 show the package forming means 14 and some further details of its association with the piecer 72. In the side elevation of FIG. 3 it can be seen that control of the positioning of the package 20 is taken over from the spinning machine by a lever 86 on the piecer. Lever 86 acts on the outer end region of arm 66 and the piecer lever 86 is pivotable by a piston and cylinder unit 88 about a pivot mounting on the piecer from a starting position indicated by the dotted line 86A.

The package lift-off mechanism on the machine always lifts the package 20 through a predetermined distance H away from the friction roll 62 regardless of the size of the package (packages of totally different size are indicated by the full line and the dotted line circles 20 in FIG. 3). The angle through which lever 86 must traverse from its starting position 86A in order to reach the lever 66 is therefore dependent upon the size of the package when the threadbreak occurred. This angular position of the arm 86 at the time it engages the arm 66 is registered and is maintained by the piecer during the subsequent end seeking operation.

If the arm 86 has to be moved slightly beyond this initial engagement position (for example, to enable release of the package lift mechanism on the machine) then the arm 86 is brought back to its initial engagement position in time for commencement of the end seeking operation. Thus, the "underside" of the package is at a designed spacing from the friction roller 62 regardless of the package size.

A yarn end seeking nozzle 90 can be moved to the position indicated in full lines in FIG. 3 in which a mouthpiece on the nozzle is located in close association with the underside of the package. Suction is applied to the nozzle 90 via a flexible connection with a suction means 91, and a broken yarn end on the package is drawn into the nozzle. Successful finding of the yarn is registered if necessary by a light beam emitted across the nozzle interior and interrupted by a found yarn end. If the yarn end sensor associated with the nozzle has not sensed the yarn therein after a predetermined time delay following initiation of the yarn seeking operation, then the control 84 terminates both the yarn seeking operation and the piecing operation and the station is accounted faulty. The station can be "marked" in a suitable manner so that service personnel can attend to the defect. The piecer can proceed to service other stations.

Assuming that the yarn end is found, nozzle 90 is moved away from the package 20 towards the dotted line position shown in FIG. 3, thereby creating a length L of yarn which will be accessible to a threading device to be further described below. During the yarn seeking operation and the subsequent threading operation, package 20 is rotated in the reverse direction by means of a roller 92 engaging the upper side of the package. Roller 92 is carried by a lever 94 pivotably mounted on the piecer 72, and an appropriate controllable drive means (not shown) is provided to rotate the roller.

Yarn Centering

FIG. 4 shows the package 20 viewed from the direction of the piecer 72 and from above. The suction nozzle is assumed to be withdrawn from the package so that the yarn length L has been created, but the orientation of this yarn length L relative to the central line C of the spinning station is completely uncontrolled immediately after the withdrawal of the suction nozzle. Accordingly, a yarn centering mechanism 96 is used to bring the yarn length L into the full line disposition indicated on FIG. 4.

Mechanism 96 comprises a carrier bar 98 which is reciprocable at right angles to the centre line C of the spinning station. Bar 98 carries a cantilever rod 100 which carries two thread guide elements 102, 104 respectively. Guide 102 has a yarn receiving slot 106 and guide 104 has a yarn receiving slot 108. Mechanism 96 is illustrated in FIG. 4 in its start position immediately after withdrawal of nozzle 90. Completion of nozzle withdrawal is indicated by suitable sensor which triggers movement of bar 98 to the right as viewed in FIG. 4 from its starting position. The extent of the right ward movement of bar 98 is sufficient to traverse slot 106 of guide 102 across the yarn length L, wherever that yarn length may happen to be lying following the seeking operation.

As seen in FIG. 4A in which the guide 102 is viewed in elevation from the direction of the package 20, the leading edge 110 of the guide 102 during this outward movement from the starting position is formed as a guide edge to direct the thread downwardly and over a lower-lip 112 into the slot 106. The other side of the slot 106, and the trailing edge of the guide 102, is formed by a downwardly projecting finger 114, which projects slightly below the lip 112 to ensure that the thread is guided into the slot 106.

Guide 104 is formed similarly to guide 102, but the guide slot 108 of guide 104 leads the guide slot 106 of the guide 102 during the outward movement by a small distance d. Since the stroke of the outward movement of bar 98 is sufficient to sweep the trailing slot 106 across the yarn length L, the yarn length is located in both slots 106 and 108 on the completion of the outward stroke. The bar 98 now begins a return stroke (to the left as viewed in FIG. 4) towards its starting position. This return stroke is, however, interrupted when the finger 114 of the guide 102 is located in alignment with a recess 116 provided in the upwardly facing surface of the guide member 58 of the machine. Bar 98 is now pivoted slightly about its own longitudinal axis so as to bring the tips of parts 112 and 114 into the recess 116; accordingly, as viewed longitudinally of the yarn length L, the slot 106 is closed by the upwardly facing surface of guide member 58 and the yarn length L is effectively guided by this "closed" slot 106 without any risk of jamming of the yarn between the finger 114 and the surface of the guide member 58 or escape of the yarn between the lip 112 and the surface of the guide member 58. The yarn length L still remains, however, in the slot 108 of the second guide 104 and because of the relative dispositions of the slots 106, 108 at this stage, the yarn length L intersects the centre line C at a slight angle as indicated in FIG. 4.

Yarn Threading

The portion of the yarn length L lying between the guides 102 and 104 is therefore accessible to the guide slot 118 (FIG. 5A) of a threading pin 120 which is moved along a threading path 122 (FIG. 5) such that the slot 118 travels along the centre line C of the spinning station. The pin 120 rises along the rearward portion (piecer side) of its path 122 between the guide 104 and the bar 98, reaches a peak P on its path slightly thereafter and begins its downward travel by intersecting the yarn length L at the point X.

In continuing its downward travel after taking up the yarn length, pin 120 sweeps out the forward portion (machine side) of its illustrated path 122. In doing so, the pin 120 passes between the drive roller 52 and the raised pressure roller 54, through an array of thread guides (further described below) in the reserve forming device 78, past a yarn clamp 124 and around an abrading roller 126. After passing the point X, pin 120 carries with it yarn which is being continuously delivered by the reverse rotation of package 20 referred to above. The yarn length extending between pin 120 and package 20 is carried by the pin along the path 122 lying on the centre line C (FIG. 4). This yarn is therefore laid by the pin 120 on a yarn path Z 1 (FIG. 6) contacting the roller 54, passing through the reserve forming devices 78, passing through the clamp 124, passing around the abrading roller 126 and extending to the nozzle 90. During the movement of the pin 120 around its path 122 (FIG. 5), diverting means (not shown) diverts the yarn extending between the pin and the nozzle 90 so that this diverted yarn is not laid along the path Z but is continually taken up by the suction nozzle.

The details of the mounting and moving means for carrying pin 120 around its path 122 have not been shown in the drawings. Pin 122 is cantilevered from its mounting means so that slot 118 is provided adjacent its free end. The pin 120 can thus project freely into the spaces between rollers 52, 54 and within the reserve device 78. The moving means can be a lever system operated from suitable cam plates 123 as is well known in the art of production of automatic yarn piecing devices.

Preliminary Steps

Figure 6:
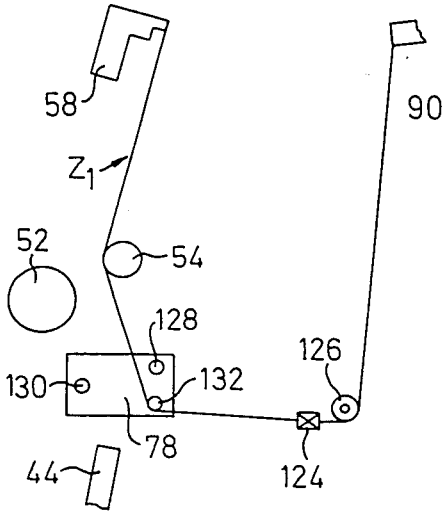
Figure 7:
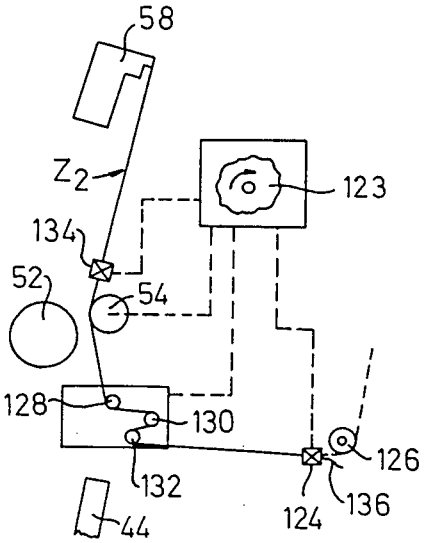

FIG. 6–9 inclusive show the series of mutations of the yarn path following completion of the threading operation. In FIG. 6, immediately after laying of the yarn on abrading roller 126, the pressure roll 54 is relatively widely spaced from the drive roll 52, the reserve device 78 is in a "receiving" condition and the clamp 124 is still open so that the yarn can continue to pass to the suction nozzle. A sensing system (not shown) senses completion of one circuit of the path 122 by pin 120, whereupon reverse rotation of the package 20 is terminated, roller 54 is brought to a position close to but still spaced from roller 52, reserve device 78 is adjusted to its "end preparation" condition and clamp 124 is closed. This gives the yarn path Z 2 shown in FIG. 7 with the yarn still extending beyond the abrading roller 126 along the dotted line portion of the path.

Reserve device 78 changes from its receiving to its end preparation condition by means of a rightward shift of a yarn guide 130 relative to a pair of yarn guides 128, 132 so that a loop of thread is formed between the guide pair 128, 132.

With the yarn still on its Z 2 path, a second yarn clamp 134 (FIG. 7–9) is moved to a position immediately downstream from the rollers 52, 54 and clamps the thread. For reasons which will be explained later, this second clamp is brought as close as possible to the rollers 52, 54. Simultaneously, the abrading roller 126 is driven into rotation anti-clockwise as viewed in FIG. 7 and cuts the yarn leaving a tail 136 of an accurately defined length extending from the clamp 124. The portion of the yarn not held by the clamp 124 is taken up by the suction nozzle 90. There is now an accurately defined length of yarn between the clamp 134 and the free end of the tail 136. The action of abrading roller 126 is such as to form a "prepared" yarn end which is particularly suitable for eventual joining with the fiber ring in the rotor. Such rollers are already well known in the art and will not be described in detail—see for example U.S. Pat. Specification No. 3,934,394.

Figure 8:
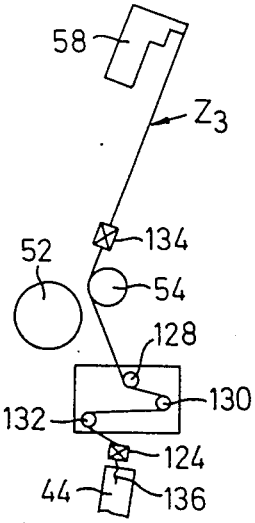
Figure 9:
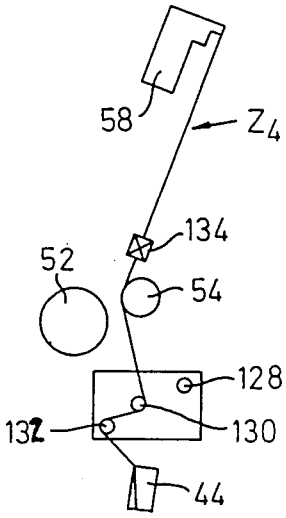

Clamp 124 is carried by a lever 138 (FIG. 5) which is pivotally mounted in the piecer 72. After completion of the yarn end preparation step, lever 138 is pivoted on its mounting to bring clamp 124 to a position immediately above the exit opening from withdrawal tube 44 (FIG. 8). During this movement of clamp 124, the relative positions of guides 128, 130 and 132 in reserve device 78 are adjusted continually to maintain the length of thread between the clamps 134 and 124 taut and under substantially constant or at least controlled tension. At the completion of this movement, the yarn lies on the path Z 3 shown in FIG. 8 with a tail 136 lying within the mouth of withdrawal tube 44. No attempt has been made in these Figures to represent accurately the geometry of this system required to produce the effect described. The diagrams merely illustrate the principles involved. The geometry of movements of the guides 128, 130 and 132 in order to compensate for the pivotal movement of the clamp 124 can be developed from the stated requirement of control of the yarn length between the clamps 124 and 134.

Clamp 124 is now released and lever 138 is pivoted back to its previous position shown in FIG. 5. Simultaneously, guide 128 is withdrawn from the yarn path, guide 130 is moved to the left relative to its position shown in FIG. 8 and guide 132 is moved to the right relative to its position shown in FIG. 8. The yarn is thus drawn along the withdrawal tube 44 under the effect of the suction in the rotor housing. At the completion of this movement, the yarn lies on path Z 4 (FIG. 9, and also FIG. 1) with a loop of yarn of defined length remaining between the guides 130 and 132 and the prepared yarn end lying at the upstream end of the withdrawal nozzle 46 (FIG. 1). It remains, therefore, to release the thread reserve defined by the guides 130 and 132 and to return pressure roll 54 into engagement with roller 52 as already described with reference to FIG. 1.

The movements described with reference to FIG. 3–9 inclusive can be controlled conveniently by a set of rotatable cam plates and levers controlled by suitable cam followers, the plates being rotated as a set. Such systems have been commonly used in the design of automatic piecers currently available and are not believed to require detailed description here. The movement described with reference to FIG. 2 are not, however, controlled by cam plates but by triggerable mechanisms. A suitable mechanism for the reserve device 78 is shown in FIG. 10.

Piecing—Final Stages

Referring to FIG. 10, guide 132 is carried by a rod 138 coupled with a piston 140 in a cylinder 142. A second rod 144 projects from the other side of piston 140. Piston 144 can be latched in its illustrated position by a latch element 146 releasable by a release mechanism 148 upon receipt of a predetermined signal. Piston 140 adopts the illustrated position and is latched therein at the completion of the preliminary operations, that is when the yarn is on path Z 4 shown in FIG. 9 and FIG. 1. Piston 140 is pressurized via air inlet 150 to cylinder 142. Port 152 is vented. Upon release of the latch 146 by the mechanism 148, piston 140 (and therefore guide 132) are urged to the right as viewed in FIG. 10 at a speed which is controllable by adjustment of the pressure applied at the inlet 150. Cylinder 142 is movable by the cam plates for the preliminary piecing operations.

As shown in FIG. 11, exactly the same principle is applicable in the case of the return movement of the roller 54. As indicated diagrammatically at 154, a strong bias is normally applied by means of a suitable spring acting between the carrier rod 56 (see also FIG. 1) for roller 54 and the cantilever arm 156 which carries the roller at its free end. This bias urges roller 54 towards its nip position with roller 52. The free end of arm 156 is also provided with an abutment surface 158 which is engaged in the "ready" condition of FIG. 9 by a latch 160 having an associated release mechanism 162 responsive to a release signal which, as will be described, is related to the start signal referred to above in description of FIG. 2. The rotatable cam which moves roller 54 away from roller 52 to its threading position (FIG. 6) and back to its ready position (FIG. 7 and FIG. 11) also acts via a lever 159 (dotted lines FIG. 11) upon the surface 158, but the lever is arranged to move away from that surface when the arm 156 reaches its ready position (FIG. 11). The latch 160 retains the arm 156 in the ready position, however, until the release signal is received.

FIG. 12 shows a part of the control 84 designed for producing the release signals. The Figure is in the form of a block diagram, block PC representing a programmable controller. When the programmable controller has received signals on inputs (indicated generally but without reference numerals) showing that the piecer is in the ready condition, controller PC sends an output to clock CL which then provides output pulses at a predetermined rate to each of counters CF, CB and CW. Each of these counters is individually settable to provide a respective output signal when it reaches its respective set count. The output signal from counter CF is fed to a mechanism operating clutch 28 to cause operation of feed roller 30 and feed of fibers into the rotor. The output of counter CB is fed to the release mechanism 148 to release the yarn reserve device 78 and the output of counter CW is fed to the release mechanism 162 to release the roll carrier arm 156.

It will be realised from the above that the timing means constituted by the clock and counters in FIG. 12 does not determine alone the period T shown in FIG. 2. That period is dependent also on the mechanical performance particularly of the trigger mechanisms and the bearing by which arm 156 is mounted upon rod 56. There is only one reserve mechanism (78) associated with the piecer 72 and its performance can be made reproduceable and can be maintained by adequate maintenance and periodic checks. However, there is one pressure roll 54 and carrier arm 156 for each individual spinning station, and a certain amount of variation in the performance of these units must be anticipated. There will therefore inevitably be at least some minor variation in the period T from position to position, but by careful attention to the bearing mechanism, the variability can be maintained within tolerable limits.

The timing means thus provides for the initiation of the re-engagement of the nip rolls from a predetermined timing reference.

As described above with reference to FIG. 2, backfeed of the yarn is completed before withdrawal of newly spun yarn is begun. It is important that a controlled length of backfed yarn should penetrate into or overlap with the fibers in the rotor groove in order to ensure adequate twist transference from the yarn to those fibers. It is thus important to provide a carefully controlled length of yarn from the clamp 134 (FIG. 9) to the prepared yarn end. Furthermore, the location of clamp 134 as close as possible to, but downstream from, the nip rolls 52, 54 helps to minimize this defined yarn length. This in turn assists in reducing variability which might be introduced due to variable stretchability of different yarn types. Some stretching of the yarn must be anticipated. The effect of the centrifugal force during the final stage of the piecing operation (and hence for a given yarn stretchability, the absolute degree of stretching of the backfed yarn) will be less for a yarn clamped immediately downstream of the nip rolls than for a yarn which is permitted to extend freely back to the package 20. Clamp 134 cannot, however, be located upstream from the nip rolls 52, 54 because there it tends to interfere with exact performance of the final piecing stage as described with reference to FIG. 2, and such interference is highly undesirable.

Clamp 134 is released automatically by linkage (not shown) to the return movement of the nip roll to forward yarn to the package 20. As already described with reference to FIG. 1, package 20 is simultaneously returned to the friction roll 52. The temporary yarn store described above with reference to FIG. 1 can be operated by the set of rotatable cam plates also referred to above. Although not shown in the drawings, the store can be brought against the yarn path Z 4 downstream from the clamp 134. Suitable temporary stores, preferably in the form of a suction tube with an open end immediately adjacent the yarn path are already well known in the art, see for example U.S. Pat. Specification No. 4,223,518.

Optional Features

Further devices, not already described above, can also be incorporated in the piecer or operated by it. For example, a yarn quality tester can be mounted on the piecer so has to be brought against the yarn path by the cam plates referred to above to test the quality of a piecing. If the quality detected is unacceptable, the programmable controller PC can be arranged to induce a thread break so that the piecing operation is repeated. The system can be programmed to provide a predetermined number of repeats, and if the quality is still unacceptable, the spinning station can be marked as defective and the piecer can terminate its piecing attempts, moving on to service another station. It is common practice to associate a yarn lubricating device with the pressure roll mounting 156. The piecer can be provided with a suitable lever to move this waxing device out of the operating range of the piecing system. Similarly, if a spinning station includes yarn tension compensation means (for example, as commonly provided where conical packages are to be formed), the piecer can also be adapted to temporarily move aside the tension compensator to avoid its interfering with the piecing operation.

A rotor speed sensing system may be used to check rotor speed. The system can be of a known type with a light transmitting tube passing through the rotor housing and permitting the piecer 72 to send a light beam through the tube to be reflected from a rotating surface, and to receive a reflected light beam. The rotating surface is provided with suitable markings modulating the reflected beam, and the piecer 72 is provided with a receiver sensitive to the modulated beam. Such a system is shown, for example, in the DE specification (Offenlegungschrift) No. 2610575.

Figure 13:
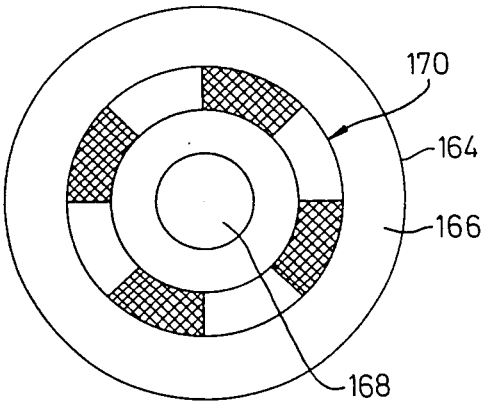

In the systems currently used it is normal practice to apply the relevant markings to a part rotating in synchronism with the rotor rather than to the rotor itself. This is not very convenient for a so called "direct bearing" rotor where the rotor itself is generally the only part readily accessible. A convenient location to provide the required markings on the rotor itself is on the rotor "floor" facing the open end of the rotor and spaced radially inwardly from the rotor groove. In FIG. 13, for example, 164 represents the rotor rim, 166 is the floor of the rotor visible through the open rotor side, 168 is a hub by means of which the rotor is connected to its drive shaft and 170 is an annular ring of markings suitable for using the speed sensing system referred to above. As illustrated, the ring 170 is divided into 8 equiangular segments which are alternately light-reflecting and non-light-reflecting. The contrast is conveniently produced by first treating the floor 166 of the rotor to provide it with a reflective surface, for example, by fine polishing and/or application of a suitable coating. The non-reflective portions are then produced by selectively etching or eroding the surface to destroy its light reflecting properties preferably by converting it to a light diffusing surface. Such marking gives good contrast and an unambiguous speed signal without being detrimental to the technology of the spinning operation.

Contrast With The Prior Art

The principles which have been outlined above are based upon recognition of the fact that currently available piecing systems have experienced difficulty in achieving close control of the piecing operation, particularly in its final phase. Without close control of this phase, it is impossible to obtain a piecing reliably at rotor speeds in excess of 40–50,000 RPM. In order to improve the success rate, the prior systems have altered the background conditions in one way or another. Such alteration of the background conditions inevitably introduces complication and expense, but in many instances it also makes the required degree of control over the final piecing phase even more difficult to achieve. For example, in a "low speed piecing" system in which yarn withdrawal is triggered at a speed below normal and on the acceleration curve of the rotor, additional variability is introduced due to variability of the rotor acceleration curve from spinning station to spinning station. The piecing operation should place a controlled quantity of twist in the piecing, and since the twist level is directly related to the rotor speed, uncontrollable variation of the rotor speed during the piecing operation makes the desired control virtually impossible.

Furthermore, low speed piecing (whether it is effected on the rotor acceleration curve or at a predetermined constant speed which is lower than the normal operating speed) introduces complication in matching the fiber feed and the withdrawal speed to the rotor speed as the rotor accelerates from its piecing speed to its normal operating speed after a successful piecing operation. The failure of such matching results in production of a substantial length of yarn having a totally different character from the yarn produced at normal rotor speed. The matching process necessitates, however, direct intervention of the piecer in control of the relevant spinning station to control its operating characteristics during the acceleration phase. Furthermore, it is extremely difficult to match the withdrawal speed to the increasing rotor speed while using the withdrawal system of the spinning station itself; for this reason the currently available systems all use an initial withdrawal path passing through a substitute withdrawal system in the piecer. The disadvantage of this arrangement is, however, that the yarn must subsequently be returned from the piecer withdrawal system to the spinning station withdrawal system, which introduces further problems.

Another approach which has been adopted is to abandon attempts to produce a carefully controlled piecing and to attempt merely to obtain a piecing which enables extraction of newly formed yarn from the spinning unit. The piecing itself can then be cut out of the yarn before winding up thereof on the package. The piecing is replaced by a knot or a splicing, the yarn being temporarily stored to enable this operation and the timing of the knotting/splicing operation therefore being less critical. The addition of the knotter/splicer clearly complicates the piecer construction and makes it more expensive.

In contrast, the principles described with reference to FIG. 2 enable as many features as possible to be held constant, reducing variability in the piecing process. The rotor speed is held constant during the piecing operation, preferably at the normal operating speed so that no subsequent matching of feed and withdrawal speeds has to be effected during a rotor acceleration phase. The performance of the backfeed system is also held constant. The length of yarn backfed can also be held constant despite variation in the rotor diameter. The prepared yarn end should not penetrate the rotor space, that is it should not leave the withdrawal nozzle before the start of the final piecing phase. The yarn end can, however, be withdrawn from the nozzle end by a suitable amount when a rotor of smaller diameter than the maximum designed rotor diameter is in use. Maintenance of these constant conditions enables the piecer to obtain close control over the final piecing phase and also enables the piecer to use the withdrawal system of the spinning station, despite minor variability from station to station.

AUXILIARY SEED YARN

The system is not limited to details of the mechanisms shown in the Figures. Nor is it limited to dealing with piecing of a broken end which has wound up on a package. Upon starting up of a machine, or after doffing of a full package, it may be necessary for the piecer to restart the spinning operation when there is no yarn already available at the spinning station itself. For this purpose, the piecer can carry an auxiliary yarn package (171, FIG. 4) from which yarn can be drawn for insertion into the spinning unit to piece with a fiber ring formed in the rotor of the unit. The auxiliary yarn can then be transferred to a bobbin tube inserted in the package cradle of the spinning station, and the auxiliary yarn can be separated from the piecer so that further take-up is effected by the station. Such systems have been proposed, for example, in Swiss Specification No. 606533. In FIG. 4, the dotted line illustration to the right of the main diagram shows a means for introducing the auxiliary yarn to the threading system. 172 is a yarn feed means drawing yarn from the auxiliary supply. 174 is a yarn manipulating means which includes a yarn take-up means, for example a suction nozzle. By bringing the mouthpiece of the suction nozzle close to the feed means 172, the suction nozzle can be made to take-up yarn from the feed means. Then, by drawing the suction nozzle away from the feed means 172 to the position shown, an accessible length of thread 176 (chain-dotted line) is produced. The stroke of the bar 98 of centering mechanism 96 is made long enough to sweep guides 102, 104 across this thread length 176.

On its return stroke, mechanism 96 draws the auxiliary yarn into the "threading position" already described in relation to a broken end and indicated at L in FIG. 4. Suction is simultaneously applied to nozzle 90 at a level sufficient to draw a loop of auxiliary yarn (indicated in dotted lines at 176A) into the nozzle between forwarding means 172 and guide 104. Threading of auxiliary yarn into the piecing system is identical to threading of a broken end; however, a knife (not shown) in forwarding means 172 is operated simultaneously with the abrading roller, so that the loop of thread drawn into the nozzle is taken up thereby.

Forwarding means 172 preferably includes both a positive forwarding means (e.g. a driven roller pair) and an air stream to direct the yarn end to the nozzle in means 174. Package 171 is replaceably supported on a carrier 169 mounted in the tender and enabling required withdrawal of yarn from the package. The forwarding means is operated to forward thread from package 171 until the yarn has been clamped by clamp 124. The suction nozzle in means 174 draws yarn continuously, but is of course ineffective to move the thread while either of clamps 124, 134 is effective.

As soon as yarn withdrawal from the spinning unit commences, manipulating device 174 is moved by means (not shown) to connect the yarn to a bobbin tube in the wind-up system. Devices to enable this are known in the art. For example, reference is made to copending patent applications Ser. Nos. 611,710 and 611,676, each filed May 18, 1984 and now U.S. Pat. Nos. 4,598,881 and 4,603,818, respectively, the disclosures of which are hereby incorporated by reference. However, the present invention is not limited to use in conjunction with the system disclosed in that co-pending application.

Control of movements of the means 174 and of the centering mechanism 196 is effected by the cam set 123 referred to above. Control of the application of suction and of the knife in the forwarding means 174 is effected by controller 84.

Thus the auxiliary seed yarn is introduced to the main piecing system at the most convenient stage thereof, namely immediately prior to the threading step. Mechanism 96 and nozzle 90 can be considered as arranged to present an accessible length of seed yarn to the threading element, and the manipulating means 174 brings the auxiliary seed yarn into operative relationship with this presenting means.

Miscellaneous Features

Figure 14:
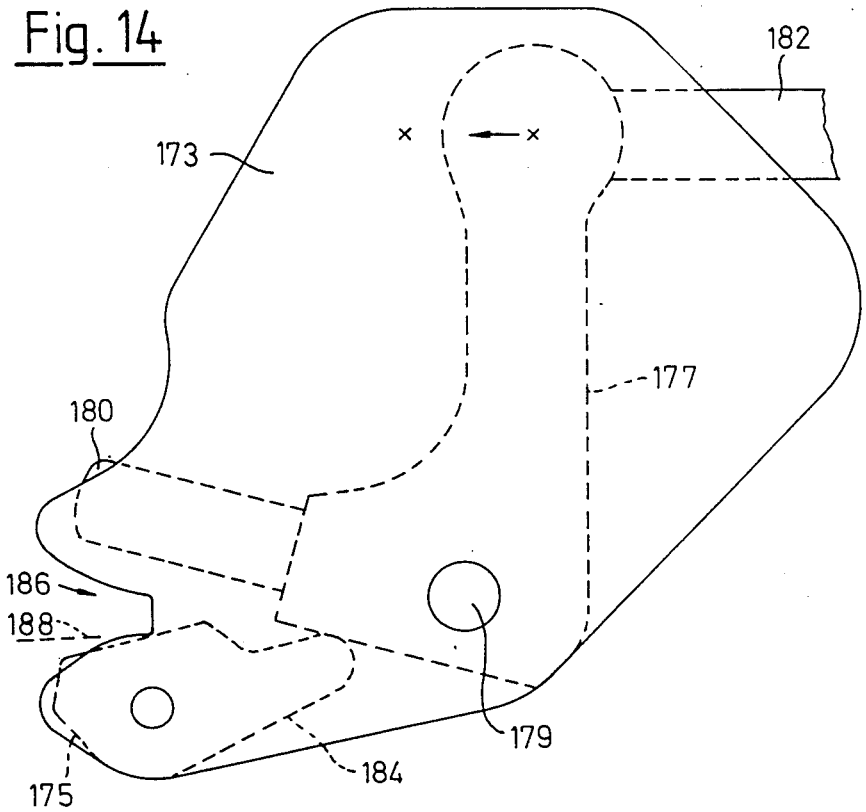

The clamping means 124 and 134 can be of substantially similar construction, each preferably being arranged to apply a controlled clamping pressure to the yarn. The basic principles of a suitable clamp construction are shown in FIG. 14. A carrier part 173 carries a pivotally mounted clamping element 175. A dogleg lever 177 is pivotally mounted on the carrier 173 at 179. One leg of the lever carries a clamping element 180 having a surface adapted to co-operate with the clamping element 175. The other leg of the lever is pivotally connected to an operating rod 182 operable by a cam follower from the cam set (for clamp 134 also from the nip roll release). Element 175 has a tail portion 184 and the element is biased (by means not shown) so that the tail portion retains contact with the dog-leg lever 177 as the latter is pivoted to open the clamp (illustrated condition). The yarn is guided to a position between the clamping elements by a centering slot 186 with the clamp open. Lever 177 is then pivoted anti-clockwise as viewed in FIG. 14 on its mounting 179, and element 175 is pivoted clockwise on its mounting because of the contact of tail 184 with lever 177. The clamping elements come into contact at the line 188 in FIG. 14 so that the yarn is clamped between the rounded surfaces of the elements 175, 180. It is released by reverse pivotal movement of the dog-leg lever on the fixed carrier 173.

Initiation of fiber feed may be effected by closing a reed switch operable to energize/de-energize an electromagnetically operated clutch 28. The reed switch may be under the control of the yarn monitor 48 and the piecer may be provided with means to operate the yarn monitor despite the absence of a yarn during the piecing operation. Operation of the yarn monitor is, however, preferably effected in a contact-free manner; the principles of such operation are well known, see for example U.S. Specification No. 4,091,606. Accordingly, detailed description is omitted in this Specification.

The position of the lever 66 at the time of contact with lever 86 (FIG. 3) on the piecer can be registered as follows. Lever 86 carries at its free end a proximity switch (not shown) which indicates contact of lever 86 with lever 66. Operation of the proximity switch operates a clamp (not shown) inside the unit 88 to register the position of lever 66. However, the clamp (and hence levers 86 and 66 now associated therewith) is movable through a short additional stroke in the cylinder, sufficient to release the machine lift-off system. The clamp then travels in reverse through its additional stroke, returning arm 66 to the registered position.

Where it is considered necessary to piece at "low speed"(i.e. at a speed substantially below the normal operating speed), the starting signal for starting the final stage of the piecing operation may be triggered by reference to sensed rotor speed instead of merely by reference to completion of preliminary operations. The control means therefore responds to the condition of the spinning unit (as represented by rotor speed or completion of preparation operations on the unit) to issue the start signal.

Means may be provided to reduce rotor speed from normal to the desired level—preferebly by cancelling rotor drive for a brief period. Rotor speed is preferably as near constant as possible during the final piecing stages. Yarn withdrawal is preferably timed in relation to the start signal.

Yarn Centering Mechanism—Modifications

A yarn centering mechanism 96 was described with reference to FIGS. 4 and 4A and the cooperation of this mechanism with a threading device for threading the yarn into an open-end spinning machine was described with reference to FIG. 5. It has now been found that a centering mechanism of the type shown in FIGS. 4 and 4A and arranged for use with cylindrical thread packages cannot be relied upon to perform its required functions when the system is adapted for operation with conical thread packages. Accordingly, an alternative centering mechanism suitable for use with both cylindrical and conical thread packages will now be described with reference to FIGS. 15–18.

Figure 15:
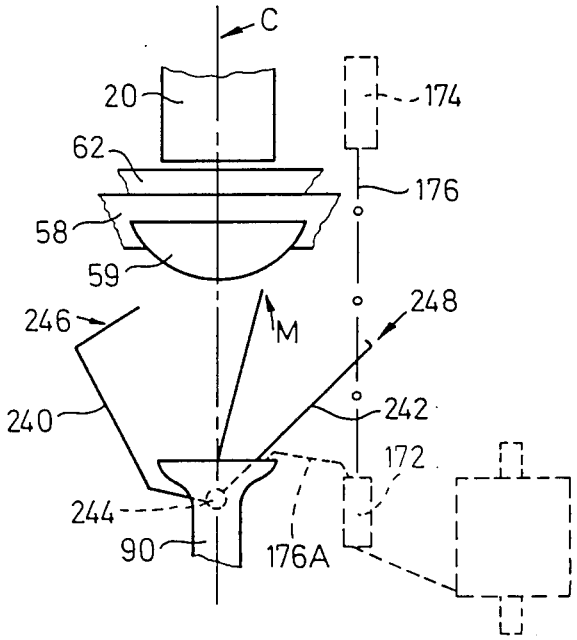
Figure 16:
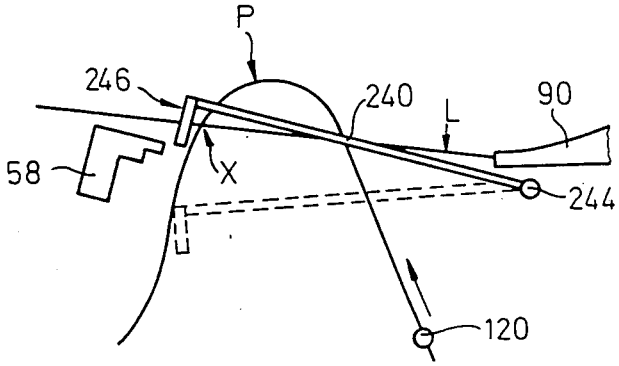

FIGS. 15 and 16 illustrate the principles involved in the new centering mechanism. In these Figures, the reference numerals correspond as far as possible with those in FIGS. 4 and 5. Thus, in FIG. 15, C represents the center line of an operating station of a yarn processing machine, e.g. a rotor spinning machine as described above. Numeral 20 indicates a package of thread forming at the operating station. This package is illustrated as cylindrical (a "cheese") but the package could equally be frusto-conical (a "cone").

Numeral 62 indicates the friction drive roll on which the package normally rests. However, as described above the package is lifted clear of the friction drive roll when a yarn break occurs and the suction end finder 90 is moved close to the underside of the package in order to draw in a broken yarn end therefrom. Nozzle 90 is then withdrawn to the position shown in FIG. 15, so that a length of yarn (not shown) extends from the package to the nozzle 90 across the intervening space. The position of this length of yarn relative to the package and relative to the nozzle 90 is uncontrolled at this stage.

Reference numeral 58 indicates a portion of the machine frame over which the yarn normally passes on its way to the package 20. Plate 59 presents a profiled edge on which the yarn is guided as it is traversed axially of the package 20 by traverse mechanism (not shown). This arrangement is well-known in the rotor spinning art and will not be described in detail as it forms no part of the present invention.

Referring now particularly to FIG. 16, letter P indicates the uppermost portion of a closed path followed by a threading device 120 for threading a broken yarn end into the yarn withdrawal system of the rotor spinning machine, i.e. the system which withdraws the formed yarn from the rotor spinning unit in normal operation. The operation of the threading means has already been described and no changes in that operation are required for use in conjunction with the new centering mechanism. Thus as element 120 travels along its path P, groove 118 straddles the plane containing the center line C of the operating station (FIG. 15).

As can be seen in FIG. 15, the new centering mechanism comprises a pair of arms 240, 242 respectively each mounted for pivotal movement about an upright axis (not shown) in a mounting 244 located below the nozzle 90 when the latter is in its withdrawn position (FIGS. 15 and 16). The upright pivot axis lies in or near the plane containing center line C. Arms 240, 242 are pivotable towards and away from each other on the mounting 244 so as to form a pair of "tongs".

Mounting 244 is itself pivotable about a substantially horizontal axis (not shown) so as to move the tongs between a lower position (dotted line in FIG. 16) and a raised position (full line in FIG. 16). During movement of nozzle 90 into its end finding position, and its subsequent withdrawal to the position shown in FIGS. 15 and 16, the tongs is maintained in its lower position so that it does not interfere with the required end finding movements of the nozzle. Thereafter, mounting 244 is pivoted so as to move the tongs to the raised position, with the arms at this stage being wide open so that they will lie to either side of the zone between package 20 and the nozzle 90, which zone contains the found yarn in an unknown disposition.

The tongs are now closed by a suitable mechanism (one example of which will be described later with reference to FIG. 17) so that the yarn is restrained between guide elements 246, 248 provided on the free ends of arms 240, 242 respectively. As will be described later with reference to FIG. 18, when the tongs are closed guides 246 and 248 cooperate to form a yarn restraining guide adapted to restrain the yarn within closely defined limits in directions normal to the center line C. Since the guides 246, 248 together sweep through the complete zone which can contain the yarn length extending between package 20 and nozzle 90, the thread must be caught by the thread restraining guide during closing of the tongs.

When the closing movement of the tongs is completed the restraining guide is caused to lie at a position M off-set to one side from the center line C (FIG. 15). The closing movement of the tongs may be arranged to be completed with the restraining guide at the position M, or the guide can be moved to that position after completion of closing of the tongs. In any event, the yarn extending from package 20 to nozzle 90 is held displaced from the center line C. In practice it is found that the yarn oscillates slightly about a line joining M to the mid-line. As viewed in side elevation (FIG. 16), however, the length of thread L extending between package 20 and the nozzle 90 at this stage intersects the path P twice.

As indicated by the arrow in FIG. 16, threading element 120 is now moved upward along the run of its path closer to nozzle 90; in the course of this upward movement, element 120 is able to pass-by the length of thread L because the latter is displaced from the center line C of the operating station.

As already described after reaching the highest point of its path P, threading element 120 starts its downward movement closer to the package 20 and to the frame of the spinning machine into which the yarn is to be threaded. After element 120 has passed-by yarn length L on the rising run of its path P, the operating mechanism of the centering device is operated to pivot the tongs about the vertical axis referred to above so as to bring the thread restraining guide formed by guides 246, 248 into the center line C. Accordingly, when threading element 120 reaches the position X on the downward run of its path P, the yarn length L has been located at this position X by the thread restraining guide, and is ready for interception by the groove 118. The threading-up operation then proceeds as previously described, release of the thread length L from the restraining guide after interception by the groove 118 will be described later with reference to FIG. 18.

As also described above it may be necessary to thread-up an operating station of a yarn handling machine when there is no previously formed package of yarn at that operating station. For example, if a previously formed package has been doffed and a fresh bobbin has been inserted at the relevant station (e.g. as described in application Ser. Nos. 611,710 and 611,676), then an auxiliary yarn carried by the service tender itself may be threaded into the operating station for the purpose of forming a piecing so as to draw a newly formed yarn from the operating station and to enable connection of that yarn to the freshly inserted bobbin (again, e.g. as shown in application Ser. Nos. 611,710 and 611,676).

FIG. 15 shows in dotted lines an auxiliary yarn handling means identical to that shown in FIG. 4 wherein like reference numerals have been used to indicate the same parts. As described the auxiliary yarn handling means can be used to create a length of thread 176 which can then be brought into cooperation with the threading element 120 by the centering mechanism. In the embodiment illustrated in FIG. 15, this is achieved by enabling the right-hand arm 242 to swing sufficiently far out from the center line C to enable it to intercept the thread length 176 and carry such a thread length into cooperation with the element 120 as already described for a length of yarn extending between the package 20 and nozzle 90. As also already described the suction produced by nozzle 90 is strong enough to draw thread length 176 into the nozzle as soon as the tongs moves said thread length into the zone between package 20 and nozzle 90 so that thread length 176 is deformed to a loop passing from the forwarding means 172 via the nozzle 90 and the tongs to the takeup means 174. Subsequent threading of the auxiliary yarn is identical to that already described for a broken yarn end.

The tongs and an operating mechanism therefor will now be described in further detail with reference to FIGS. 17 and 18.

Figure 17:
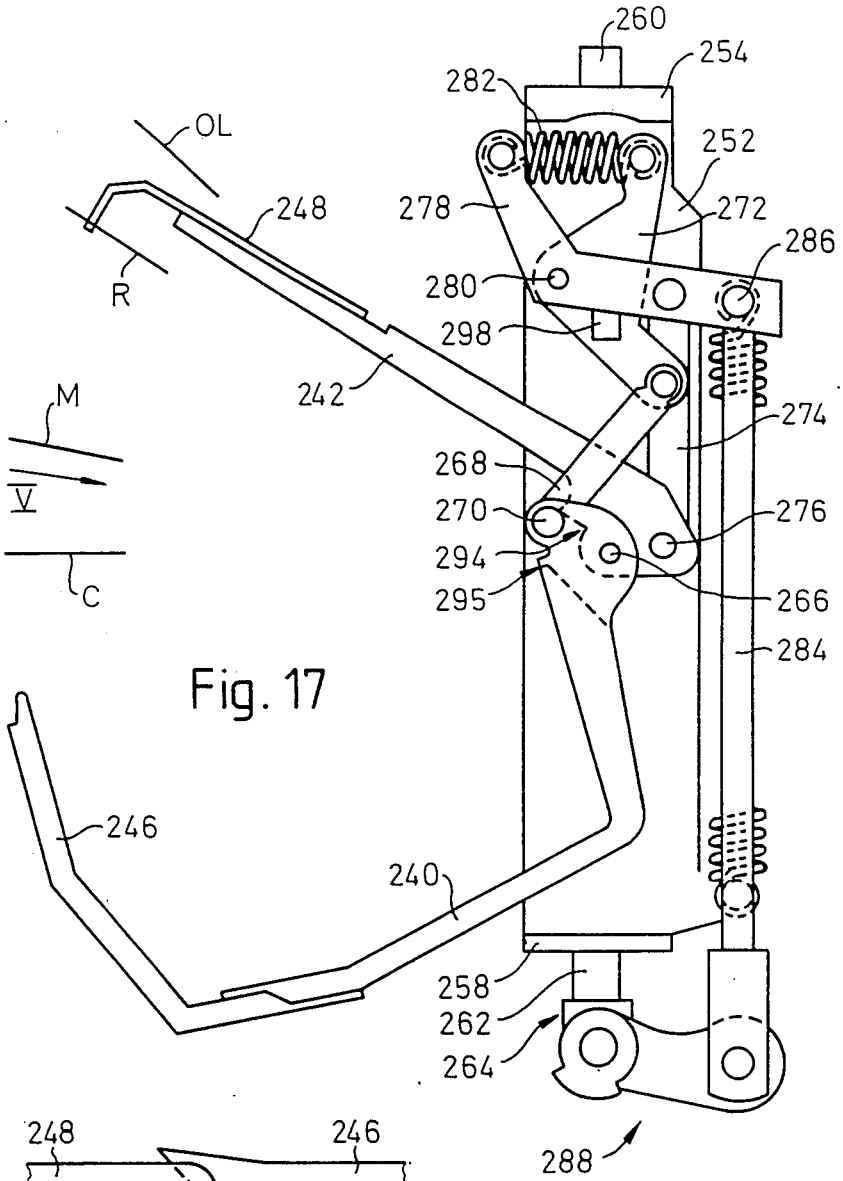

In FIG. 17, mounting 244 comprises a carrier, comprising a pair of parallel plates 252, 254 respectively joined at their ends by spacers 258 to form an open-sided box structure. Most of plate 254 has been cut away in FIG. 17 in order to show the interior of this box structure. Projecting from one spacer 258 is a stub shaft 260 for cooperation with a suitable bearing in the frame of the service tender (not shown). Projecting from the other spacer 258 is a second stub shaft 262 (coaxial with shaft 260) cooperating with a rotating mechanism indicated diagrammatically at 264 and also provided on the non-illustrated frame on the service tender. Mechanism 264 is operable to rotate the box structure about the axis passing longitudinally through shafts 260, 262, thereby raising and lowering the tongs as already described in broad outline with reference to FIG. 16.

A pin 266 extends between and is secured to each of plates 252, 254. Each of arms 240, 242 is pivotally mounted on pin 266 which provides the pivot axis lying in the plane containing line C as described with reference to FIG. 15. As seen clearly in FIG. 17, each of arms 240, 242 comprises a complex lever extending from the mounting pin 266 through the "front", open side of the box structure. Arm 240 is mounted above arm 242 on the pin 266.

Movement of arm 240 about pin 266 is caused by a rod 268 pivotally connected to arm 240 at 270 and pivotally connected at its other end to one leg of a bell-crank lever 272. Pivotal movement of arm 242 on pin 266 is caused and controlled by a rod 274 pivotally connected to arm 242 at 276 and pivotally connected at its opposite end to one leg of a second bell-crank lever 278. Levers 272 and 278 are pivotable about a common axis defined by a bearing pin 280 extending between and mounted in plates 252, 254. The legs of levers 272, 278 which are not connected to the rods 268, 274 respectively are joined by a tension spring 282.

The "drive" for this mechanism is provided by a reciprocable rod 284 which is pivotally connected at 286 to an extension on the first-mentioned leg of bell crank lever 278, the extension carrying that leg beyond its pivotal connection with rod 274 in a direction away from the pivot axis provided by pin 280. A drive mechanism diagrammatically indicated at 288 is operable to move rod 284 selectively in either longitudinal direction from the position shown in FIG. 17.

Figure 18:
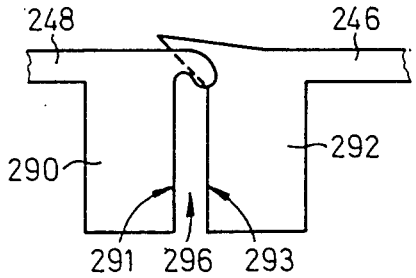

The portions of guide elements 246, 248 which are adjacent when the tongs are closed are illustrated in elevation in FIG. 18 as viewed in the direction of the arrow V in FIG. 17. As can be seen in FIG. 18, elements 246, 248 each carry a depending portion 290, 292 respectively. The facing edges 291, 293 of the depending portions 290, 292 respectively are spaced as shown in FIG. 18 when the tongs are "closed", at which time the arms 240, 242 engage at 294, 295 (FIG. 17). The tongs is raised to a sufficient height relative to the yarn length L (FIG. 16) to ensure that the yarn is engaged by one of the facing edges 291, 293 on portions 290 and 292, so that the thread is located in the elongated "slot" 296 which remains between the depending portions when the tongs is closed. The width of this "slot" is so chosen relative to the count of the yarn being processed that the yarn is accurately located in directions transverse to the length of the slot, but is freely movable longitudinally of the slot towards and through the open lower end thereof. The yarn can therefore be carried out of the slot and thus out of the restraining guide means provided by edges 291, 293 on portions 290, 292, after interception by the threading element 120 as described above.

Portion 290 has a hook projecting towards portion 292, which latter has a pointed projection which lies behind the hook projection (without contacting it) when the tongs is closed. The V-projection guides an engaged yarn downwardly relative to position 292, while the hook prevents a restrained thread rising out of slot 296.

The tongs is illustrated in its "starting" or "parked" position in FIG. 17. As the tongs is pivoted towards its raised position, rod 284 is drawn towards mechanism 288. Rod 274 therefore pivots arm 242 in a clockwise direction about pin 266 so as to increase the degree of opening of the tongs. This carries the edge 291 on depending portion 290 from position R to an outer limit OL (FIG. 17) which is so located as to ensure that depending portion 290 will collect an auxiliary thread 176 (FIG. 15) on its closing stroke. Due to engagement between bell-crank lever 278 and an upstanding abutment 298 secured to bell-crank lever 272, the latter is also forced to rotate in a clockwise direction around the pin 280. Rod 268 thus rotates arm 240 in an anti-clockwise direction about the pin 266 thereby further widening the tongs in this initial operating movement.

When the tongs reaches its raised position, it has been fully opened, and the mechanism 288 is reversed to cause movement of rod 284 away from mechanism 288. Rod 274 rotates arm 242 back towards the center line C. Bell-crank 272 is also caused to rotate in an anti-clockwise direction as viewed in FIG. 17 about pin 280 because of the spring connection 282 with bell-crank lever 278. The tongs therefore closes at position M (see also FIG. 15) by engagement of faces 294, 295. Throughout this closing movement, abutment 298 will remain in contact with bell-crank lever 278.

After closing at position M the tongs remains in this position for a predetermined period during which the threading element 120 moves past the yarn length L on the upward run of its path P as described with reference to FIG. 16. When there is no further risk of interference between the yarn and the threading element, mechanism 288 is re-started to continue the interrupted movement of rod 284. Arm 242 is therefore pivoted further in the anti-clockwise direction as viewed in FIG. 17 towards center line C. In the course of this movement, it drives arm 240 in an anti-clockwise direction about pin 266, thereby drawing abutment 298 away from bell-crank lever 278 and extending the spring 282. The movement of rod 284 is terminated when the slot 296 has been caused to straddle the center line C as already described with reference to FIG. 15.

The system has been described in operation with a cylindrical package 20. There is no significant difference in its operation with a conical package. The box structure and the tongs carried thereby will be tilted to correspond to the conicity. Provided the depending portions 290, 292 (FIG. 18) are made long enough, this has no significant influence upon the ability of the tongs to catch a thread extending between the package and the nozzle 90.

In the embodiment illustrated in FIG. 17, arm 240 has been formed as a dog-leg lever and the guide member 246 extends a substantial distance from arm 240 towards arm 242. This enables substantial spacing of the "parallel" portions of arms 240, 242 when the tongs are closed, so that threading element 120 can pass between arms 240, 242 both when they are closed at the position M and when they are closed on the center line C. This is not essential. The arms could be disposed wholly above the path P of the threading element 120, and the depending portions 290, 292 could be adapted accordingly.

One example of an operating mechanism for moving the arms in the required manner has been described with reference to FIG. 17. This mechanism could, e.g. be operated from a set of cams and cam-followers which also operates the threading element in a desired timed relationship as already described. However, this also is not essential. Tong-type guide systems, and operating mechanisms therefor, have already been described e.g. as in U.S. Specification Nos. 3,855,771 and 3,478,504, and the principles of such systems could be adapted for use in the present invention.

The centering mechanism shown in FIGS. 15–18 provides a convenient alternative to that shown in FIGS. 4 and 5. At the same time, it enables the threading element itself to travel along a fixed path with the groove 118 travelling in a plane containing the center line C of the operating station. This is advantageous for convenience of threading of the yarn into the operating station itself. If the threading element could be "parked" at a position adjacent the uppermost position on its threadpath, then it may be unnecessary to hold the yarn in a temporarily displaced position (M in FIGS. 15 and ); instead, the yarn could be moved directly to the center line C by the tongs. However, such an arrangement might cause difficulty in connection with free movement of the nozzle 90 in its end finding function.

The service tender may be driven, guided and located by a system as described in application Ser. No. 611,746 filed May 18, 1984.

It is not of course essential that the tongs be made to interrupt its movements at any stage. However, the tongs preferably closes to one side of the center line C. If it then moves directly to the center line orientation without any delay, there must be careful timing of the tongs operation relative to the operation of the threading element. The important point is that the yarn is held displaced from the center line orientation (or any other selected orientation corresponding to the path of the threading element) until after the threading element has passed through the required orientation for the first time and the yarn is moved to the required orientation before the threading element passes through that orientation for the second time.

The threading system shown in FIGS. 5–9 is designed for a rotor spinning machine. This is of course not essential. The cooperation of the yarn centering mechanism with a yarn threading element as described herein could be applied to other types of yarn handling machines, for example to threading of a yarn end into a knotting or splicing device on a back winding machine.

Furthermore, neither the yarn centering mechanism nor a threading system cooperating therewith is limited to use on travelling service tenders. For example, in some back winding machines the operating stations are mounted on a movable frame and can be moved past a stationary service station. The yarn centering mechanism could be applied to such a system. The yarn centering mechanism could also be used in a system employing one set of servicing equipment per operating station, although such systems are becoming increasingly uneconomical with the development of travelling service tenders.

Similarly, the cooperation of the auxiliary seed yarn handling device with the threading mechanism is not limited to use in rotor spinning machines.

We claim:

1. In combination, a spinning machine having a plurality of spinning stations, each said station including a spinning unit for spinning a yarn therein, feed means for feeding sliver to said spinning unit and a pair of nip rolls for withdrawing a yarn from said spinning unit; and a travelling piecing apparatus movable along said machine for selective positioning with a respective spinning station, said apparatus including first means for separating said nip rolls of a selected station, second means for forming a yarn reserve in a seed yarn for back-feeding into said spinning unit of a selected station, control means to actuate said feed means of a selected station to feed sliver to said spinning unit thereof, said second means to release a yarn reserve for back-feeding to said spinning unit and said first means to re-engage said nip rolls for withdrawing of the seed yarn with the newly spun yarn pieced thereto, and timing means in said control means to time initiation of the re-engagement of said nip rolls from a predetermined timing reference.

2. The combination as set forth in claim 1 wherein said timing means is operable to actuate said second means from said timing reference.

3. The combination as set forth in claim 1 wherein said control means is responsive to said spinning unit reaching a selected operated speed.

4. The combination as set forth in claim 1 wherein each station includes bias means for biasing said nip rolls together and said first means includes releasable retaining means to retain said nip rolls in a separated condition against the force of said bias means.

5. The combination as set forth in claim 1 wherein said apparatus includes a yarn end suction nozzle for finding a broken yarn end on a package at a selected spinning station for subsequent delivery to said second means as a seed yarn.

6. The combination as set forth in claim 1 wherein said apparatus includes an auxialiary yarn package and a yarn manipulating means for drawing a yarn from said package for subsequent delivery to said second means as a seed yarn.

7. In combination, a spinning machine having at least one spinning station including a spinning unit for spinning a yarn therein, feed means for feeding sliver to said spinning unit and a pair of nip rolls for withdrawing a yarn from said spinning unit; and a travelling piecing apparatus movable along said machine for selective positioning with said spinning station, said apparatus including first means for separating said nip rolls, second means for forming a yarn reserve in a seed yarn for back-feeding into said spinning unit and control means to actuate said feed means to feed sliver to said spinning unit at the beginning of a predetermined selective variable time period, said second means to release a yarn reserve for back-feeding to said spinning unit during said time period and said first means to re-engage said nip rolls for withdrawing of the seed yarn with the newly spun yarn pieced thereto in response to expiration of said time period.

8. The combination as set forth in claim 7 wherein said control means is responsive to said spinning unit reaching a selected operating speed to actuate said feed means.

9. A travelling piecing apparatus for a spinning machine having a plurality of spinning stations each having a spinning unit, feed means for feeding sliver to the unit and a pair of nip rolls for withdrawing yarn from the unit; and piecing apparatus comprising first means for separating said nip rolls of a selected station;

second means for forming a yarn reserve in a seed yarn for back-feeding into the spinning unit of a selected station and control means to actuate the feed means of a selected station, said second means to release a yarn reserve to the spinning unit and said first means to re-engage the nip rolls for withdrawing of the seed yarn with the newly spun yarn pieced thereto, and timing means in said control means to time initiation of the re-engagement of said nip rolls from a predetermined timing reference.

10. A travelling piecing apparatus for a winding machine comprising means for separating a pair of nip rolls at a selected spinning station of the winding machine;

means for threading a seed yarn between the separated nip rolls; and yarn clamp means operable to clamp the seed yarn at a location downstream of the nip rolls and to release the seed yarn upon re-engagement of the nip rolls.

11. In combination, a spinning machine having a plurality of spinning stations, at least one station including a spinning unit, a pair of nip rolls for withdrawing a yarn from said spinning unit and a package forming means downstream of said nip rolls, and a travelling piecing apparatus movable along said machine for selective positioning at at least said one station, said apparatus including first means for separating said nip rolls, means for threading a seed yarn between said separated rolls for back-feeding to said spinning unit and yarn clamp means downstream of said separated nip rolls for clamping the seed yarn to provide a controlled length of seed yarn extending therefrom for backfeeding to said spinning unit.

12. The combination as set forth in claim 11 wherein said apparatus includes control means for re-engaging said nip rolls while opening said clamp means.

13. A method of automatically piecing a broken yarn on a package being wound in a spinning machine having at least one station including a spinning unit and a pair of nip rolls for withdrawing a yarn from the spinning unit; said method comprising the steps of separating the nip rolls;

threading the broken yarn between the nip rolls;

forming a yarn reserve in the yarn between the nip rolls and the spinning unit;

feeding sliver to the spinning unit to form a fiber ring while back-feeding the yarn from said yarn reserve to the spinning unit during a predetermined time period to piece the end of the broken yarn to the fiber ring; and re-engaging the nip rolls to commence withdrawal of the pieced yarn from the spinning rotor at the expiry of said time period.

14. A method as set forth in claim 13 wherein the speed of the spinning unit is maintained constant during said time period.

15. A method as set forth in claim 13 which further comprises the steps of forming a prepared end on the broken yarn and pre-locating the prepared end relative to the spinning unit prior to back-feeding of the yarn from said yarn reserve.

16. A method as set forth in claim 13 wherein the spinning unit is maintained at a speed of at least 40,000 revolutions per minute.

17. A method of automatically starting a winding operation in a spinning machine having at least one station including a spinning unit and a pair of nip rolls for withdrawing a yarn from the spinning unit, said method comprising the steps of separating the nip rolls, threading a yarn from an auxiliary package on a travelling piecing apparatus between the nip rolls;

forming a yarn reserve in the yarn between the nip rolls and the spinning unit;

feeding sliver to the spinning unit to form a fiber ring while back-feeding the yarn from said yarn reserve to the spinning unit during a predetermined time period to piece the end of the broken yarn to the fiber ring; and re-engaging the nip rolls to commince withdrawal of the pieced yarn from the spinning rotor at the expiry of said time period.

18. A method as set forth in claim 17 wherein the spinning unit is maintained at a speed of at least 40,000 revolutions per minute.

* * * * *